US011719470B2

(12) United States Patent
Mizuno

(10) Patent No.: US 11,719,470 B2
(45) Date of Patent: Aug. 8, 2023

(54) CRYOCOOLER AND CRYOGENIC SYSTEM

(71) Applicant: SUMITOMO HEAVY INDUSTRIES, LTD., Tokyo (JP)

(72) Inventor: Yoji Mizuno, Nishitokyo (JP)

(73) Assignee: SUMITOMO HEAVY INDUSTRIES, LTD, Tokyo (JP)

( * ) Notice: Subject to any disclaimer, the term of this patent is extended or adjusted under 35 U.S.C. 154(b) by 245 days.

(21) Appl. No.: 17/160,361

(22) Filed: Jan. 27, 2021

(65) Prior Publication Data

US 2021/0262702 A1 Aug. 26, 2021

(30) Foreign Application Priority Data

Feb. 25, 2020 (JP) ..... 2020-029619

(51) Int. Cl.
*F25B 9/14* (2006.01)

(52) U.S. Cl.
CPC ..... *F25B 9/14* (2013.01)

(58) Field of Classification Search
CPC ..... F25B 9/14
See application file for complete search history.

(56) References Cited

U.S. PATENT DOCUMENTS

2020/0240702 A1* 7/2020 Adachi ..... F25B 9/14
2021/0065945 A1* 3/2021 Ma ..... H01F 6/065

FOREIGN PATENT DOCUMENTS

JP 5675578 B2 2/2015
JP 2016211803 A 12/2016
JP 2017198369 A * 11/2017
JP 6559462 B2 8/2019

OTHER PUBLICATIONS

Adachi, Mounting structure and mounting method of cryogenic refrigerator, 2017, Full Document (Year: 2017).*

* cited by examiner

*Primary Examiner* — Nael N Babaa
(74) *Attorney, Agent, or Firm* — HEA Law PLLC

(57) ABSTRACT

Provided is a cryocooler configured to be mountable on a vacuum container to cool a liquid refrigerant container. The cryocooler includes an attachment flange forming a refrigerant gas chamber between a mounting port of the vacuum container and the attachment flange when the cryocooler is mounted on the mounting port, and movable in a detachment direction by raising a pressure of the refrigerant gas chamber, and a cooling stage cooling an object to be cooled disposed inside the vacuum container and movable from a cooling position in contact with the object to be cooled to a non-cooling position separated from the object to be cooled in response to a movement of the attachment flange in the detachment direction. The refrigerant gas chamber is connected to the liquid refrigerant container.

8 Claims, 3 Drawing Sheets

10

CRYOCOOLER AND CRYOGENIC SYSTEM

RELATED APPLICATIONS

The content of Japanese Patent Application No. 2020-029619, on the basis of which priority benefits are claimed in an accompanying application data sheet, is in its entire incorporated herein by reference.

BACKGROUND

Technical Field

Certain embodiments of the present invention relate to a cryocooler and a cryogenic system.

Description of Related Art

In the related art, a thermal switch is known which can disconnect or connect thermal coupling between a cryocooler and an object to be cooled, for example, such as a superconducting coil. When a power supply detection relay detects that the cryocooler is not operated, a cold head is disconnected from the object to be cooled by driving a raising and lowering device.

SUMMARY

According to an aspect of the present invention, there is provided a cryocooler configured to be mountable on a vacuum container to cool a liquid refrigerant container. The cryocooler includes an attachment flange forming a refrigerant gas chamber between a mounting port of the vacuum container and the attachment flange when the cryocooler is mounted on the mounting port, and movable in a detachment direction by raising a pressure of the refrigerant gas chamber, and a cooling stage cooling an object to be cooled disposed inside the vacuum container and movable from a cooling position in contact with the object to be cooled to a non-cooling position separated from the object to be cooled in response to a movement of the attachment flange in the detachment direction. The refrigerant gas chamber is connected to the liquid refrigerant container.

According to another aspect of the present invention, there is provided a cryogenic system including a liquid refrigerant container disposed inside a vacuum container, and including a container wall that separates a liquid refrigerant from a vacuum region and a recondensing portion provided on the container wall, and a cryocooler mounted on the vacuum container to cool the liquid refrigerant container. The cryocooler includes an attachment flange forming a refrigerant gas chamber between a mounting port of the vacuum container and the attachment flange when the cryocooler is mounted on the mounting port, and movable in a detachment direction by raising a pressure of the refrigerant gas chamber, and a cooling stage disposed in the vacuum region to cool the recondensing portion, and movable from a cooling position in contact with the recondensing portion to a non-cooling position separated from the recondensing portion in response to a movement of the attachment flange in the detachment direction. The refrigerant gas chamber is connected to the liquid refrigerant container.

DETAILED DESCRIPTION

Figure 1:
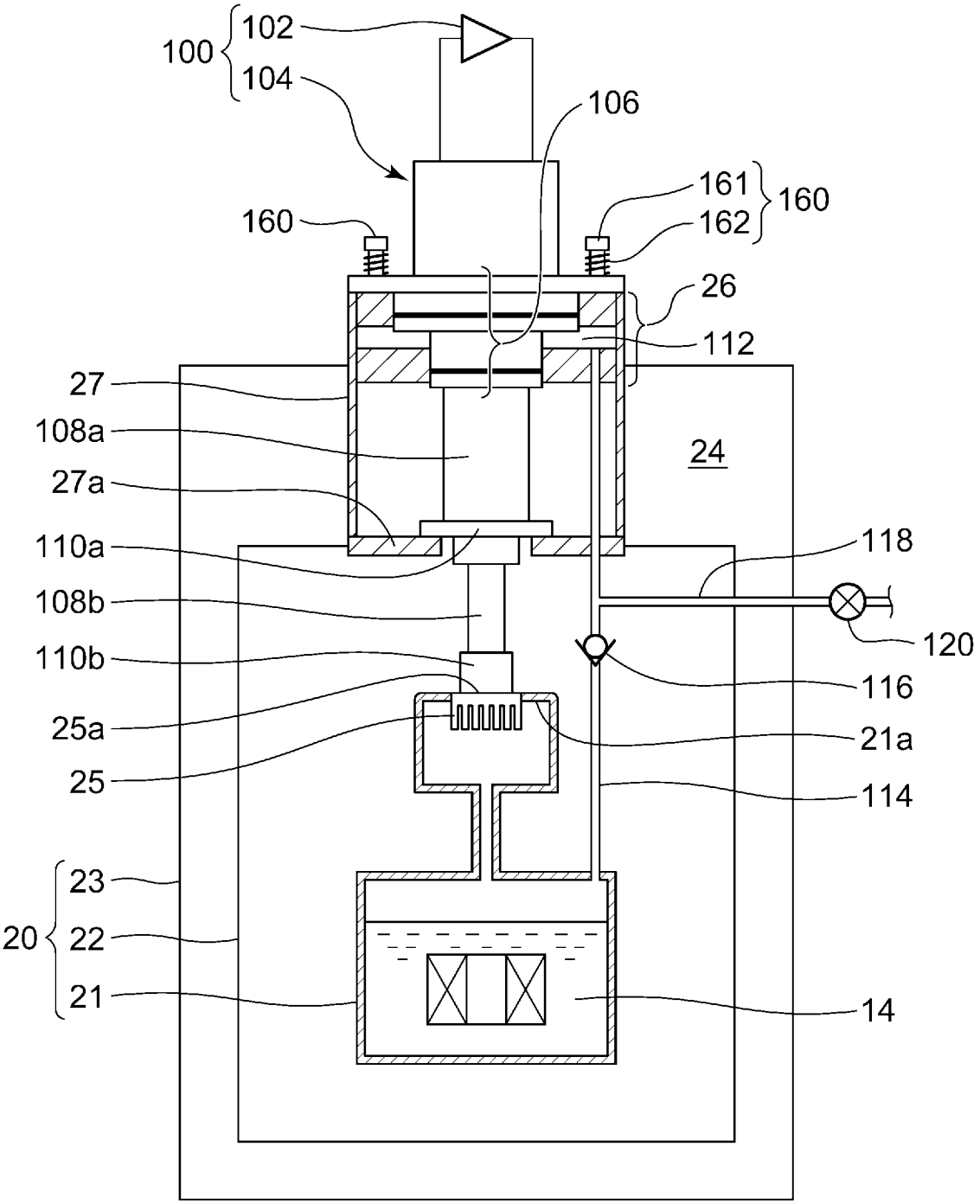
FIG. 1 is a view schematically illustrating a cryogenic system to one embodiment.

It is desirable to provide a novel mechanism which can automatically disconnect a cryocooler from an object to be cooled when cooling capacity of the cryocooler is degraded.

Any desired combination of the above-described components, and those in which the components or expressions according to the present invention are substituted from each other in methods, devices, or systems are effectively applicable as an aspect of the present invention.

According to an embodiment of the present invention, the cryocooler can be automatically disconnected from the object to be cooled when cooling capacity of the cryocooler is degraded.

Hereinafter, embodiments of the present invention will be described in detail with reference to the drawings. In the description and the drawings, the same reference numerals will be assigned to the same or equivalent components, members, or processes, and repeated description will be omitted as appropriate. A scale or a shape of each illustrated element is set for convenience of description, and is not to be interpreted in a limited manner unless otherwise specified. The embodiments are merely examples, and do not limit the scope of the present invention in any way. All features and combination thereof which are described in the embodiments are not necessarily essential to the invention.

FIG. 1 is a view schematically illustrating a cryogenic system 10 according to one embodiment. The cryogenic system 10 is configured to cool an object to be cooled 12 by immersion cooling. That is, the object to be cooled 12 is cooled to a cryogenic temperature by heat exchange with a liquid refrigerant 14 having a cryogenic temperature. The object to be cooled 12 is completely or partially immersed in the liquid refrigerant 14, and is in direct contact with the liquid refrigerant 14. Alternatively, a flow path and/or a pipe through which the liquid refrigerant 14 flows may be provided inside and/or around the object to be cooled 12. The liquid refrigerant 14 and the object to be cooled 12 may exchange heat via the flow path and/or the pipe.

In this embodiment, for example, the cryogenic system 10 may be a part of a magnetic resonance imaging (MRI) system or a superconducting system having a superconducting device such as a superconducting magnet. The object to be cooled 12 may be a superconducting coil. For example, the liquid refrigerant 14 is liquid helium. The superconducting coil is immersed in the liquid refrigerant 14. In this manner, the superconducting coil is cooled to a cryogenic temperature equal to or lower than a critical temperature for achieving superconductivity.

The cryogenic system 10 includes a cryostat 20 and a cryocooler 100. The cryostat 20 is configured to internally provide a cryogenic temperature vacuum environment, accommodates the object to be cooled 12 and the liquid refrigerant 14, and holds both of these in the cryogenic temperature vacuum environment. The cryostat 20 is equipped with the cryocooler 100 to cool the liquid refrigerant 14. The cryocooler 100 can indirectly cool the object to be cooled 12 by using the liquid refrigerant 14.

The cryostat 20 includes a liquid refrigerant container 21, a heat shield 22, and a vacuum container 23.

The liquid refrigerant container 21 is configured to accommodate the liquid refrigerant 14 together with the object to be cooled 12. Alternatively, when a flow path and/or a pipe through which the liquid refrigerant 14 flows is provided in the object to be cooled 12, the liquid refrigerant container 21 may be used as a storage tank for the liquid refrigerant 14, and the object to be cooled 12 may be disposed outside the liquid refrigerant container 21. The liquid helium is usually used as the liquid refrigerant 14. Accordingly, the liquid refrigerant container 21 can also be called a liquid helium tank.

The liquid refrigerant container 21 is disposed inside the vacuum container 23, and includes a container wall 21*a* that separates the liquid refrigerant 14 from a vacuum region 24 and a recondensing portion 25 provided on the container wall 21*a*. The recondensing portion 25 is cooled from the outside of the liquid refrigerant container 21 by the cryocooler 100. The recondensing portion 25 has a heat transfer surface 25*a* exposed outward of the liquid refrigerant container 21 and in contact with the cryocooler 100. The recondensing portion 25 may have fin shapes or irregularities inside the liquid refrigerant container 21 in order to increase a surface area in contact with the liquid refrigerant 14.

As an exemplary configuration, the liquid refrigerant container 21 may have a first chamber for accommodating the liquid refrigerant 14 (and the object to be cooled 12) and a second chamber provided with the recondensing portion 25. The first chamber and the second chamber may be connected to each other so that the gas of the liquid refrigerant 14 vaporized in the first chamber can be received from the first chamber to the second chamber, and the liquid refrigerant 14 recondensed in the second chamber can return from the second chamber to the first chamber. Alternatively, the recondensing portion 25 and the liquid refrigerant 14 may be accommodated in the same chamber.

The heat shield 22 is disposed around the liquid refrigerant container 21 inside the vacuum container 23. The heat shield 22 is configured to thermally protect the liquid refrigerant container 21 and the object to be cooled 12 from radiant heat that may enter from the outside of the heat shield 22.

The vacuum container 23 is configured to isolate the vacuum region 24 formed therein from an ambient environment of the cryostat 20. The vacuum container 23 may be provided with a vacuum pump (not illustrated) for evacuating the inside of the vacuum container 23, or may be connectable to the vacuum pump. A heat insulating layer formed of a heat insulating material may be provided between the vacuum container 23 and the heat shield 22. The ambient environment outside the vacuum container 23 may be a room temperature atmospheric pressure environment.

The vacuum container 23 is provided with a mounting port 26 for mounting the cryocooler 100 on the vacuum container 23. The mounting port 26 is configured so that the cryocooler 100 is mounted to be detachable. During the mounting, the cryocooler 100 is inserted into the vacuum container 23 from the mounting port 26, and in a state where the low-temperature section of the cryocooler 100 is disposed inside the vacuum container 23, a room temperature portion of the cryocooler 100 is attached to the mounting port 26.

As an example, the mounting port 26 is formed in a top plate or an upper portion of the vacuum container 23. The cryocooler 100 is installed in the cryostat 20 so that a center axis thereof coincides with a vertical direction. However, an attachment posture of the cryocooler 100 is not limited thereto. The cryocooler 100 can be installed in any desired posture, and may be installed in the cryostat 20 so that the center axis coincides with an oblique direction or a horizontal direction.

The cryostat 20 includes a cold head sleeve 27 extending into the vacuum container 23 from the mounting port 26 of the vacuum container 23. The cold head sleeve 27 extends to the heat shield 22 to surround the cryocooler 100 coaxially with the cryocooler 100. The inside of the cold head sleeve 27 serves as the vacuum region 24, as in other places inside the vacuum container 23. A heat transfer stage 27*a* cooled by the cryocooler 100 is attached to a sleeve end portion on the heat shield 22 side. The heat transfer stage 27*a* may be a portion of the heat shield 22, or may be connected to the heat shield 22 via a proper heat transfer member. A central portion of the heat transfer stage 27*a* has an opening into which the cryocooler 100 is inserted.

The cold head sleeve 27 may further extend inward of the heat shield 22 inside the vacuum container 23, for example, to the liquid refrigerant container 21. In this case, the cold head sleeve 27 may have an additional heat transfer stage thermally coupled to the recondensing portion 25. The additional heat transfer stage may be cooled by the cryocooler 100. In this manner, the recondensing portion 25 may be cooled.

The cryocooler 100 includes a compressor 102 and a cold head 104. The compressor 102 is configured to recover the working gas of the cryocooler 100 from the cold head 104, to raise the pressure of the recovered working gas, and to supply the working gas to the cold head 104 again. The cold head 104 is also called an expander or a cryocooler. The compressor 102 and the cold head 104 forma refrigeration cycle of the cryocooler 100. In this manner, the low-temperature section 110*a*, 110*b* is cooled to a desired cryogenic temperature. The working gas is also called a refrigerant gas, and is usually the helium gas. However, other suitable gases may be used.

In general, both the pressure of the working gas supplied from the compressor 102 to the cold head 104 and the pressure of the working gas recovered from the cold head 104 to the compressor 102 are considerably higher than the atmospheric pressure, and can be respectively called a first high pressure and a second high pressure. For convenience of description, the first high pressure and the second high pressure are simply called a high pressure and a low pressure, respectively. Typically, the high pressure is 2 to 3 MPa, for example. For example, the low pressure is 0.5 to 1.5 MPa, and is approximately 0.8 MPa, for example.

The cold head 104 includes an attachment flange 106 mounted on the mounting port 26 of the vacuum container 23. In addition, in this embodiment, the cryocooler 100 is a two-stage Gifford-McMahon (GM) cryocooler, and the cold head 104 includes a first cylinder 108*a*, a second cylinder 108*b*, and a first cooling stage 110*a*, and a second cooling stage 110*b*. The cylinder and the cooling stage are disposed in the vacuum region 24 when the cold head 104 is mounted on the vacuum container 23. The first cylinder 108*a* is disposed inside the cold head sleeve 27, and connects the attachment flange 106 to the first cooling stage 110*a*. The second cylinder 108*b* is disposed inside the heat shield 22, and connects the first cooling stage 110*a* to the second cooling stage 110*b*.

The first cooling stage 110*a* is cooled to a first cooling temperature, for example, lower than 100K (for example, approximately 30K to 60K), and the second cooling stage 110*b* is cooled to a second cooling temperature lower than the first cooling temperature, for example, approximately 4K or lower.

Although details will be described later, the attachment flange 106 of the cold head 104 forms a refrigerant gas chamber 112 between the mounting port 26 and the attachment flange 106 when mounted on the mounting port 26 of the vacuum container 23. Due to the pressure acting on the refrigerant gas chamber 112, the attachment flange 106 can move with respect to the mounting port 26 in a state of being mounted on the mounting port 26 of the vacuum container 23.

In this embodiment, the cryocooler 100 is allowed to move in a direction of a center axis thereof (upward-downward direction in FIG. 1). Components of the above-described cold head 104, that is, the attachment flange 106, the first cylinder 108*a*, the second cylinder 108*b*, the first cooling stage 110*a*, and the second cooling stage 110*b* are rigidly connected to each other.

Therefore, in association with the relative movement of the attachment flange 106 with respect to the mounting port 26, the first cooling stage 110*a* and the second cooling stage 110*b* are integrally moved. The relative movement enables the cold head 104 to move from a cooling position to a non-cooling position or from the non-cooling position to the cooling position.

At the cooling position, the cooling stage of the cold head 104 comes into contact with the object to be cooled inside the vacuum container 23. That is, at the cooling position, the first cooling stage 110*a* comes into contact with the heat transfer stage 27*a*, and the second cooling stage 110*b* comes into contact with the heat transfer surface 25*a* of the recondensing portion 25. Therefore, the heat transfer stage 27*a* and the heat shield 22 can be cooled to the first cooling temperature by the first cooling stage 110*a*, and the recondensing portion 25 can be cooled to the second cooling temperature by the second cooling stage 110*b*.

On the other hand, at the non-cooling position, the cooling stage is separated from the object to be cooled. That is, at the non-cooling position, the first cooling stage 110*a* is separated from the heat transfer stage 27*a*, and the second cooling stage 110*b* is separated from the heat transfer surface 25*a* of the recondensing portion 25. Therefore, the heat transfer stage 27*a* and the heat shield 22 can be insulated from the first cooling stage 110*a* by a vacuum state between the first cooling stage 110*a* and the heat transfer stage 27*a*. The recondensing portion 25 may be insulated from the second cooling stage 110*b* by a vacuum state between the second cooling stage 110*b* and the heat transfer surface 25*a*.

The cryostat 20 is provided with a refrigerant gas pipe 114 that connects the liquid refrigerant container 21 to the refrigerant gas chamber 112. The gas of the liquid refrigerant 14 vaporized inside the liquid refrigerant container 21 can be supplied from the liquid refrigerant container 21 to the refrigerant gas chamber 112 through the refrigerant gas pipe 114. As an example, the refrigerant gas pipe 114 passes through the inside of the cold head sleeve 27 from the attachment flange 106, penetrates the heat transfer stage 27*a* (or the heat shield 22), extends inside the heat shield 22, and reaches the liquid refrigerant container 21. In this example, the whole refrigerant gas pipe 114 is disposed inside the vacuum container 23 (that is, the vacuum region 24). However, a portion of the refrigerant gas pipe 114 may pass through the outside the vacuum container 23, and may extend to the attachment flange 106 (that is, the refrigerant gas chamber 112).

The refrigerant gas pipe 114 includes a check valve 116 disposed so that the refrigerant gas can be introduced from the liquid refrigerant container 21 into the refrigerant gas chamber 112. That is, the check valve 116 is disposed in the refrigerant gas pipe 114 to allow a gas flow from the liquid refrigerant container 21 to the refrigerant gas chamber 112, and to block the gas flow in a direction opposite thereto. In FIG. 1, the check valve 116 is disposed inside the heat shield 22. However, the check valve 116 may be disposed in other places on the refrigerant gas pipe 114 (for example, inside the cold head sleeve 27 or outside the vacuum container 23).

In addition, the cryostat 20 is provided with a purge line 118 which enables the gas to be discharged outward in order to cope with an excessive increase in an internal pressure of the liquid refrigerant container 21. The purge line 118 branches from the refrigerant gas pipe 114, and reaches the outside of the cryostat 20. The purge line 118 branches from the refrigerant gas pipe 114 between the refrigerant gas pipe 114 and the check valve 116. Therefore, the purge line 118 can discharge the gas outward of the cryostat 20 not only from the liquid refrigerant container 21 but also from the refrigerant gas chamber 112. A position of the purge line 118 branching from the refrigerant gas pipe 114 may be any desired location on the refrigerant gas pipe 114. The purge line 118 may be directly connected to the refrigerant gas chamber 112 instead of the refrigerant gas pipe 114.

The purge line 118 is provided with a safety valve 120. The safety valve 120 is configured to be opened when the internal pressure is higher than an external pressure by exceeding an allowable pressure. The safety valve 120 may be configured to serve as a valve to be electrically or mechanically opened, based on a differential pressure acting between an inlet and an outlet, or the safety valve 120 may be a burst disk. In FIG. 1, the safety valve 120 is disposed outside the cryostat 20, but may be disposed in other places on the purge line 118.

A route of the gas of the vaporized liquid refrigerant 14 of the refrigerant gas chamber 112, the refrigerant gas pipe 114, and the purge line 118 is divided from a circulation circuit of the working gas between the compressor 102 and the cold head 104 for operating the cryocooler 100. The gas of the liquid refrigerant 14 does not flow into the cold head 104, or the working gas inside the cold head 104 does not flow out to the refrigerant gas chamber 112 or the refrigerant gas pipe 114.

Figure 2:
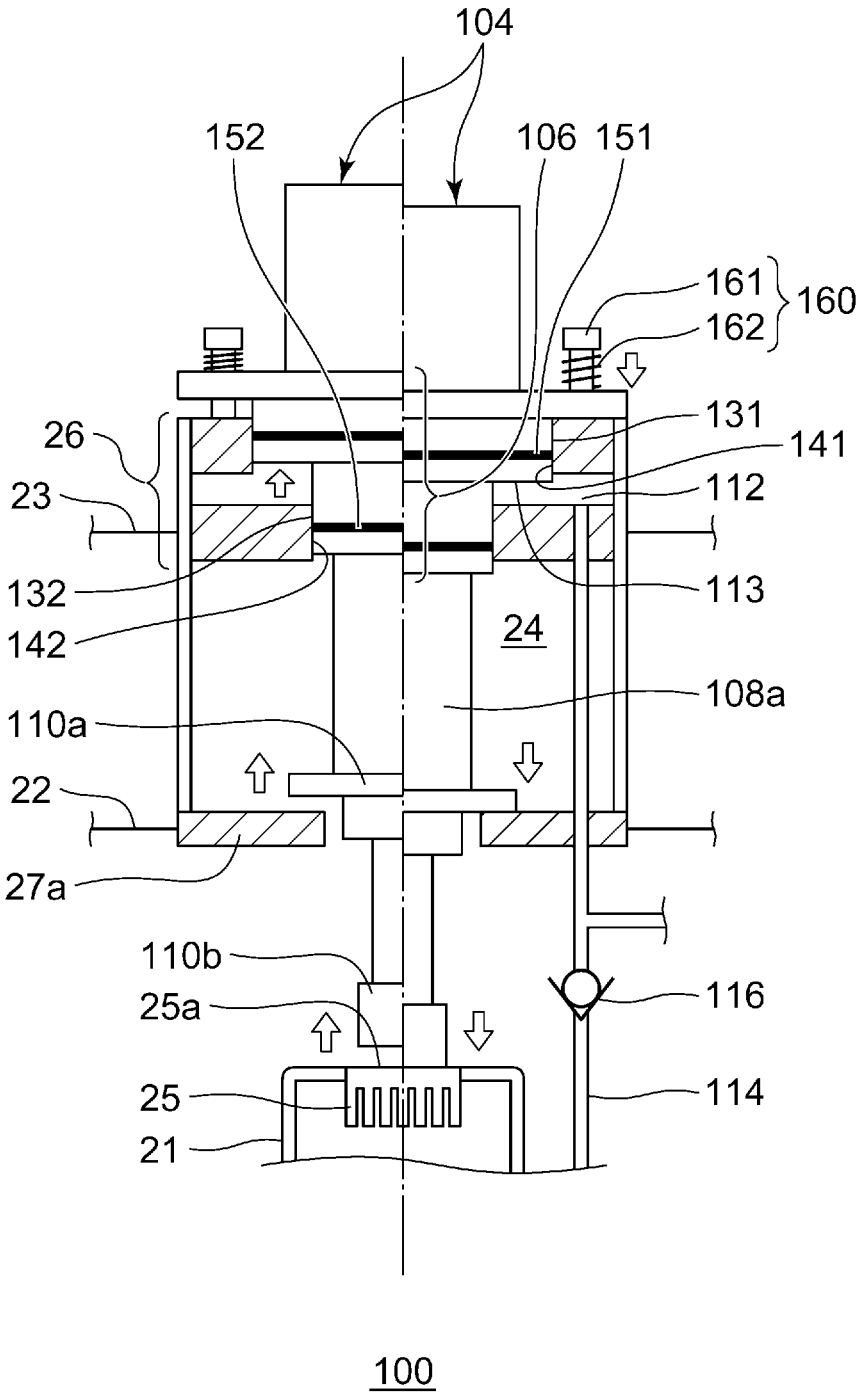
FIG. 2 illustrates a cooling position and a non-cooling position for the cryocooler illustrated in FIG. 1.

FIG. 2 illustrates the cryocooler 100 illustrated in FIG. 1. In FIG. 2, in order to facilitate understanding in comparison, the cryocooler 100 when located at the cooling position is illustrated in the right half, and the cryocooler 100 when located at the non-cooling position is illustrated in the left half.

When the cryocooler 100 is mounted on the mounting port 26 of the vacuum container 23, as described above, the refrigerant gas chamber 112 is formed between the attachment flange 106 and the mounting port 26. The attachment flange 106 can be moved in a detachment direction by raising the pressure of the refrigerant gas chamber 112. The first cooling stage 110*a* and the second cooling stage 110*b* can move from the cooling position to the non-cooling position in response to the movement of the attachment flange 106 in the detachment direction.

In this embodiment, the mounting port 26 is provided in an upper portion of the vacuum container 23, and the cold head 104 is inserted from the mounting port 26 to be mounted on the vacuum container 23. Accordingly, the "detachment direction" is an upward direction in the drawing. The attachment direction of the cold head 104 is a direction opposite to the detachment direction. Accordingly, the attachment direction is a downward direction in the drawing.

The attachment flange 106 isolates the vacuum region 24 inside the vacuum container 23 from the external ambient environment when the attachment flange 106 is mounted on the mounting port 26, and functions as a vacuum flange. The attachment flange 106 has a stepped shape whose diameter gradually decreases from the ambient environment side toward the vacuum region 24. An upper portion of the attachment flange 106 exposed to the ambient environment has the largest diameter. An intermediate portion of the attachment flange 106 has the diameter smaller than that of the upper portion, and a lower portion of the attachment flange 106 has the diameter smaller than that of the intermediate portion. The first cylinder 108*a* has the diameter smaller than that of the lower portion of the attachment flange 106. The upper portion, the intermediate portion, and the lower portion of the attachment flange 106 respectively have a disc shape, and are disposed coaxially with the center axis of the cold head 104 together with the first cylinder 108*a*. In the drawing, thicknesses (axial dimensions) of the upper portion, the intermediate portion, and the lower portion gradually increase in this order. However, the configuration is not limited thereto.

The attachment flange 106 has a first flange peripheral surface 131 which is the outer peripheral surface of the intermediate portion, and a second flange peripheral surface 132 which is the outer peripheral surface of the lower portion of the attachment flange 106. Corresponding to the two flange peripheral surfaces, the mounting port 26 has a first guide surface 141 and a second guide surface 142. The first flange peripheral surface 131 comes into slidable contact with the first guide surface 141, and the second flange peripheral surface 132 comes into slidable contact with the second guide surface 142. A sliding direction is the detachment direction and the attachment direction (that is, the axial direction) of the cold head 104. The second flange peripheral surface 132 and the second guide surface 142 have the diameter smaller than that of the first flange peripheral surface 131 and the first guide surface 141. The first guide surface 141 and the second guide surface 142 may be regarded as a portion (for example, an upper end portion) of the cold head sleeve 27.

The attachment flange 106 includes a first seal 151 and a second seal 152. The first seal 151 is held between the first guide surface 141 and the first flange peripheral surface 131, and seals the refrigerant gas chamber 112 from the external environment of the vacuum container 23. The second seal 152 is held between the second guide surface 142 and the second flange peripheral surface 132, and seals the refrigerant gas chamber 112 from the vacuum region 24 inside the vacuum container 23. The second seal 152 has the diameter smaller than that of the first seal 151. Each of the two seals extends in an annular shape over an entire periphery between the flange peripheral surface and the guide surface which correspond to each other. As the first seal 151 and the second seal 152, a dynamic sealing material such as a dynamic O-ring and a slipper seal is used. As illustrated, in this embodiment, the first seal 151 and the second seal 152 are mounted on the respectively corresponding flange peripheral surfaces. However, alternatively, both of these may be mounted on the guide surface. If applicable, the first seal 151 and the second seal 152 may be non-contact seals instead of contact seals.

Since the first seal 151 and the second seal 152 are provided, the pressure of the refrigerant gas chamber 112 can be held at a pressure respectively different from those of the ambient environment and the vacuum region 24. When the refrigerant gas is received by refrigerant gas chamber 112, it is possible to prevent the refrigerant gas from leaking to the ambient environment and the vacuum region 24.

In addition, the attachment flange 106 includes a refrigerant gas chamber forming surface 113 that connects the first flange peripheral surface 131 and the second flange peripheral surface 132 to each other. The refrigerant gas chamber forming surface 113 faces the refrigerant gas chamber 112, and faces the direction opposite to the detachment direction of the attachment flange 106. In the illustrated example, the refrigerant gas chamber forming surface 113 is a downward surface, and faces the cooling stage side. The refrigerant gas chamber forming surface 113 is at least a portion of the upper surface (ceiling surface) of the refrigerant gas chamber 112. For example, the refrigerant gas chamber forming surface 113 is a portion of a plane perpendicular to the center axis of the cold head 104, and has an annular shape to connect the two flange peripheral surfaces to each other. The second flange peripheral surface 132 is located to be lower than the first flange peripheral surface 131 in the axial direction. Accordingly, the refrigerant gas chamber forming surface 113 connects a lower edge of the first flange peripheral surface 131 and an upper edge of the second flange peripheral surface 132.

The refrigerant gas chamber forming surface 113 faces the direction opposite to the detachment direction of the attachment flange 106. Accordingly, the force in the detachment direction acts on the refrigerant gas chamber forming surface 113 due to the pressure of the refrigerant gas in the refrigerant gas chamber 112. When the gas is introduced into the refrigerant gas chamber 112, a force that lifts the cold head 104 can be applied to the attachment flange 106.

However, the refrigerant gas chamber forming surface 113 is not limited to the above-described configuration, and may have other shapes. The refrigerant gas chamber forming surface 113 may have an inclined surface and/or a curved surface so that a force having a component in the detachment direction of the attachment flange 106 acts on the refrigerant gas chamber forming surface 113 by the pressure of the refrigerant gas in the refrigerant gas chamber 112.

The attachment flange 106 may include a portion (for example, an upper end portion) of the first cylinder 108*a*. The first flange peripheral surface 131, the second flange peripheral surface 132, and the refrigerant gas chamber forming surface 113 may be formed in the upper end portion of the first cylinder 108*a*.

The attachment flange 106 includes a pressing mechanism 160 that elastically presses the attachment flange 106 against the vacuum container 23 in a direction opposite to the detachment direction. In this embodiment, the pressing mechanism 160 includes a plurality of columns 161 and a plurality of springs 162. The plurality of columns 161 are fixed to the vacuum container 23 to surround the mounting port 26 at an equal interval in the circumferential direction, for example. For example, the column 161 is a bolt, and is fastened to a bolt hole around the mounting port 26. A hole or a notch through which the column 161 penetrates is formed in the upper portion of the attachment flange 106 mounted on the vacuum container 23. The attachment flange 106 is movable along the column 161. Each of the springs 162 is mounted on the column 161 to be in a compressed state between a head portion of the corresponding column 161 and the attachment flange 106. In this manner, the spring 162 can generate an elastic force that presses the attachment flange 106 against the vacuum container 23.

The pressing mechanism 160 can prevent excessive movement of the attachment flange 106 in the detachment direction. When the attachment flange 106 moves upward with an excessive stroke in the drawing, the first seal 151 and the second seal 152 are respectively separated upward from the first guide surface 141 and the second guide surface 142, and a sealing function may be impaired. However, the attachment flange 106 is pressed against the vacuum container 23 by the pressing mechanism 160. In this manner, a moving stroke of the attachment flange 106 can be held within a proper range. In addition, in a cooling state, the pressing mechanism 160 can press the cooling stage against the object to be cooled by pressing the attachment flange 106, which is helpful for reduced thermal resistance between the cooling stage and the object to be cooled.

The pressing mechanism 160 may not be required when gravity can be used to press the attachment flange 106 against the vacuum container 23, such as when a self-weight of the cold head 104 is sufficiently heavy.

Hitherto, a configuration of the cryogenic system 10 according to the embodiment has been described. Subsequently, an operation thereof will be described.

In a normal state, the cold head 104 is located at the cooling position, as illustrated on the right side of FIG. 2. The first cooling stage 110*a* comes into contact with the heat transfer stage 27*a*, and the second cooling stage 110*b* comes into contact with the heat transfer surface 25*a* of the recondensing portion 25. The cooling stages are respectively pressed against the objects to be cooled by the self-weight of the pressing mechanism 160 and the cold head 104 (schematically illustrated by the downward arrows). The heat transfer stage 27*a* and the heat shield 22 can be cooled to the first cooling temperature by the first cooling stage 110*a*, and the recondensing portion 25 can be cooled to the second cooling temperature by the second cooling stage 110*b*.

The liquid refrigerant 14 stored in the liquid refrigerant container 21 is vaporized by cooling the object to be cooled 12. The gas of the vaporized liquid refrigerant 14 is cooled and recondensed by touching the recondensing portion 25. In this way, the pressure inside the liquid refrigerant container 21 is held at the atmospheric pressure or other proper pressures, for example. The pressure of the refrigerant gas chamber 112 is also held at the atmospheric pressure, for example, is adjusted not to have a significant differential pressure from the pressure inside the liquid refrigerant container 21. Therefore, the check valve 116 of the refrigerant gas pipe 114 is closed, and the refrigerant gas does not flow into the refrigerant gas chamber 112 from the liquid refrigerant container 21.

When the cooling capacity of the cryocooler 100 is degraded due to a failure or a temporarily unstable operation of the cryocooler 100, vaporization of the liquid refrigerant 14 in the liquid refrigerant container 21 is promoted, and the pressure of the liquid refrigerant container 21 may be higher than the pressure of the refrigerant gas chamber 112. When the check valve 116 is opened by the differential pressure, the refrigerant gas is supplied from the liquid refrigerant container 21 to the refrigerant gas chamber 112 through the refrigerant gas pipe 114, and the pressure of the liquid refrigerant container 21 is introduced into the refrigerant gas chamber 112.

As illustrated on the left side of FIG. 2, the raised pressure of the refrigerant gas chamber 112 pushes up the refrigerant gas chamber forming surface 113. The first flange peripheral surface 131 and the second flange peripheral surface 132 respectively slide with respect to the first guide surface 141 and the second guide surface 142, and the attachment flange 106 is moved in the detachment direction. In response to the movement of the attachment flange 106 in the detachment direction, the first cooling stage 110*a* and the second cooling stage 110*b* are also moved from the cooling position to the non-cooling position (schematically illustrated by an upward arrow). At the non-cooling position, the first cooling stage 110*a* is separated from the heat transfer stage 27*a*, and the second cooling stage 110*b* is separated from the recondensing portion 25. Due to the vacuum state between the cooling stage and the object to be cooled, the object to be cooled is insulated from the cold head 104.

In a situation where the cooling capacity of the cryocooler 100 is lost or significantly degraded, when thermal connection by lifting the cold head 104 is not released, the cold head 104 itself substantially forms a heat transfer route that directly connects the ambient environment of the cryostat 20 to the liquid refrigerant 14 inside the liquid refrigerant container 21. In this case, the heat considerably enters the liquid refrigerant container 21 and the liquid refrigerant 14. There is a risk that the vaporization of the liquid refrigerant 14 is further promoted and the internal pressure of the liquid refrigerant container 21 is excessively higher.

However, according to this embodiment, the refrigerant gas is introduced into refrigerant gas chamber 112 in accordance with the degraded cooling capacity of the cryocooler 100, the cryocooler 100 can be automatically and thermally disconnected from the object to be cooled. In this way, it is possible to prevent the heat from entering the liquid refrigerant 14 in which the cold head 104 is used as the heat transfer route. The vaporization of the liquid refrigerant 14 is slowed down, and the object to be cooled 12 can be continuously cooled by the liquid refrigerant 14 for the time being.

For example, when the object to be cooled 12 is the superconducting coil, the degraded cooling capacity of the cryocooler 100 may cause quenching. However, occurrence of the quenching can be delayed by the cooling using the liquid refrigerant 14.

In a thermal switch having a configuration in the related art, an operating state of the cryocooler is detected, and a drive mechanism is electrically operated to disconnect the cryocooler. Accordingly, a detector and a drive mechanism are required. In contrast, according to this embodiment, the thermal switch can be realized with a simple configuration. The refrigerant gas naturally generated due to the degraded cooling capacity of the cryocooler 100 and the raised pressure are used. Accordingly, a dedicated detector or a dedicated drive mechanism is not required. Therefore, even in an unforeseen situation such as a power failure, the cryocooler 100 can be disconnected from the object to be cooled such as the recondensing portion 25.

The check valve 116 is opened when a certain minimum differential pressure (hereinafter, also referred to as a valve opening pressure) acts between the inlet and the outlet, and the gas flow is allowed from the liquid refrigerant container 21 to the refrigerant gas chamber 112. The valve opening pressure of the check valve 116 may be higher than the pressure of the refrigerant gas chamber 112 when the cold head 104 is lifted. In this case, when the check valve 116 is opened, a pressure exceeding the pressure capable of lifting the cold head 104 is immediately introduced into the refrigerant gas chamber 112. Accordingly, the cold head 104 can be lifted with satisfactory responsiveness.

The raised pressure of the refrigerant gas chamber 112 can be released by using the purge line 118 (by opening the safety valve 120). In this way, the pressure of the refrigerant gas chamber 112 can be lowered. The cold head 104 can return from the non-cooling position to the cooling position. When the pressing mechanism 160 is provided, the cold head 104 can automatically return to the cooling position by using an elastic pressing force of the pressing mechanism 160. Alternatively, the cold head 104 may be pushed to return to the cooling position either manually or by using power.

Figure 3:
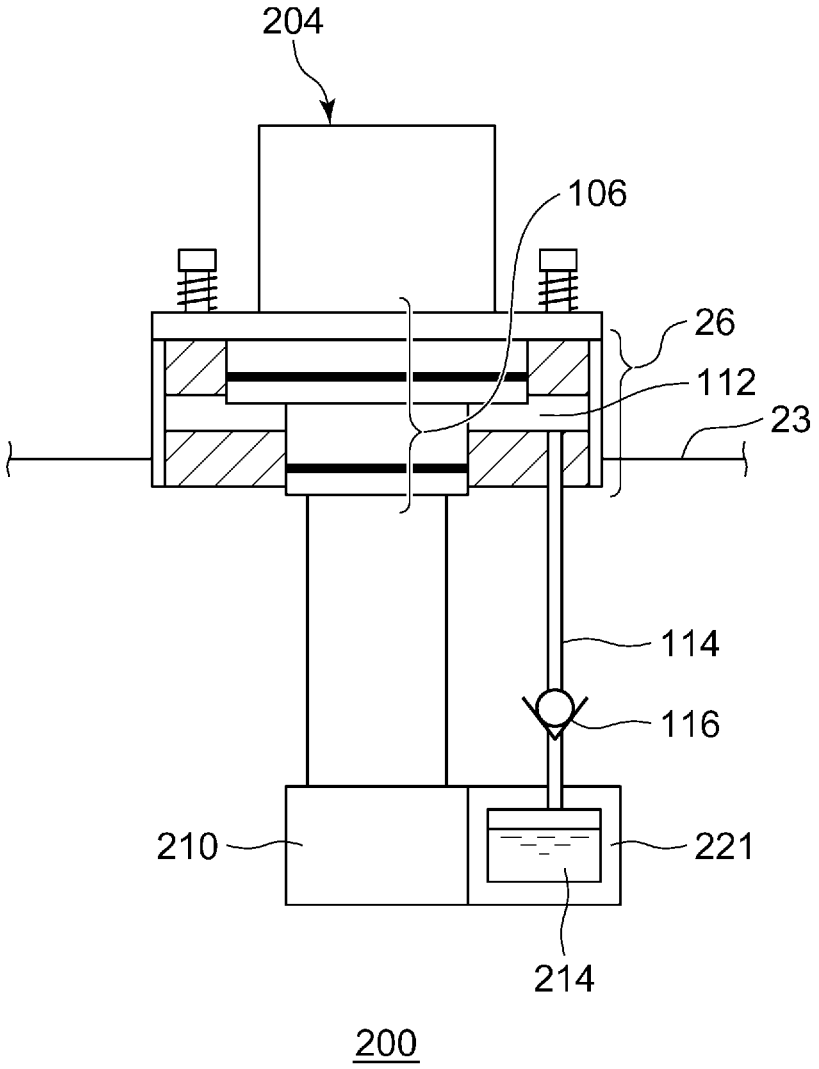
FIG. 3 is a view schematically illustrating a cryocooler according to another embodiment.

FIG. 3 is a view schematically illustrating a cryocooler 200 according to another embodiment. The cryocooler 200 according to the embodiment is different from the cryocooler 100 according to the previously described embodiment in terms of the liquid refrigerant container, and the remaining configurations are is generally common to each other. Hereinafter, different configurations will be mainly described, and common configurations will be briefly described or omitted.

As an example, the cryocooler 200 is a single-stage GM cryocooler. A cold head 204 of the cryocooler 200 includes the attachment flange 106 and a cooling stage 210. When the cold head 204 is mounted on the mounting port 26 of the vacuum container 23, as described above, the refrigerant gas chamber 112 is formed between the attachment flange 106 and the mounting port 26. The attachment flange 106 can be moved in a detachment direction by raising the pressure of the refrigerant gas chamber 112. The cooling stage 210 can move from the cooling position to the non-cooling position in response to the movement of the attachment flange 106 in the detachment direction.

The cold head 204 further includes a liquid refrigerant container 221 and the refrigerant gas pipe 114 that connects the liquid refrigerant container 221 to the refrigerant gas chamber 112, and the liquid refrigerant container 221 is fixed to the cooling stage 210. When the cooling stage 210 is cooled by the operation of the cryocooler 200, the liquid refrigerant container 221 is cooled by the cooling stage 210. The liquid refrigerant container 221 accommodates a liquid refrigerant 214 liquefied at a cooling temperature of the cooling stage 210, such as liquid nitrogen, for example. The refrigerant gas pipe 114 may be provided with the check valve 116.

Therefore, as in the previously described embodiment, according to the present embodiment, when the cooling capacity of the cryocooler 200 is degraded, the liquid refrigerant 214 is vaporized in the liquid refrigerant container 221, thereby raising the pressure of the refrigerant gas chamber 112. The cold head 204 can be pushed up from the cooling position to the non-cooling position by raising the pressure of the refrigerant gas chamber 112.

The cryocooler 200 according to the present embodiment is also applicable to cryogenic cooling using a so-called conduction cooling type. As is known, in the conduction cooling, no liquid refrigerant is used to cool the object to be cooled such as the superconducting coil, for example. The object to be cooled or the heat transfer member connected to the object to be cooled comes into direct contact with the cooling stage 210 when the cooling stage 210 is located at the cooling position, is thermally coupled therewith, and is directly cooled without using the liquid refrigerant. When the cooling stage 210 is located at the non-cooling position, the cooling stage 210 is separated from the object to be cooled.

The cryocooler 200 may be configured to serve as a two-stage GM cryocooler. In this case, the liquid refrigerant container 221 may be fixed to the second cooling stage. In this case, as in the previously described embodiment, the liquid helium may be used as the liquid refrigerant.

Hitherto, the present invention has been described, based on the embodiments. The present invention is not limited to the above-described embodiments. It will be understood by those skilled in the art that various design changes can be made, various modification examples can be made, and the modification examples also fall within the scope of the present invention. Various features described with regard to a certain embodiment are also applicable to other embodiments. A new embodiment acquired from the combination compatibly achieves respective advantageous effects of the combined embodiment.

In the above-described embodiments, as an example, the cryocoolers 100 and 200 are the single-stage or the two-stage Gifford-McMahon (GM) cryocoolers. However, a pulse tube cryocooler, a Sterling cryocooler, or other types of the cryocooler may be adopted.

The present invention has been described by using specific terms and phrases, based on the embodiments. However, the embodiment shows only one aspect of principles and applications of the present invention. The embodiment allows many modification examples and disposition changes within the scope not departing from the idea of the present invention defined in the appended claims.

It should be understood that the invention is not limited to the above-described embodiment, but may be modified into various forms on the basis of the spirit of the invention. Additionally, the modifications are included in the scope of the invention.

What is claimed is:

1. A cryocooler configured to be mountable on a vacuum container to cool a liquid refrigerant container, the cryocooler comprising:

an attachment flange forming a refrigerant gas chamber between a mounting port of the vacuum container and the attachment flange when the cryocooler is mounted on the mounting port, and movable in a detachment direction by raising a pressure of the refrigerant gas chamber; and a cooling stage cooling an object to be cooled disposed inside the vacuum container and movable from a cooling position in contact with the object to be cooled to a non-cooling position separated from the object to be cooled in response to a movement of the attachment flange in the detachment direction, wherein the refrigerant gas chamber is connected to the liquid refrigerant container, wherein the cryocooler further comprises:

the liquid refrigerant container; and a refrigerant gas pipe connecting the liquid refrigerant container to the refrigerant as chamber.

2. The cryocooler according to claim 1, wherein the attachment flange includes:

a first flange peripheral surface coming into slidable contact with a first guide surface of the vacuum container, a second flange peripheral surface coming into slidable contact with a second guide surface of the vacuum container and having a diameter smaller than that of the first flange peripheral surface, and a refrigerant gas chamber forming surface connecting the first flange peripheral surface and the second flange peripheral surface to each other and facing a direction opposite to the detachment direction.

3. The cryocooler according to claim 2, wherein the attachment flange includes:

a first seal held between the first guide surface and the first flange peripheral surface and sealing the refrigerant gas chamber from an external environment of the vacuum container, and a second seal held between the second guide surface and the second flange peripheral surface and sealing the refrigerant gas chamber from a vacuum region inside the vacuum container.

4. The cryocooler according to claim 1, wherein the attachment flange includes a pressing mechanism that elastically presses the attachment flange against the vacuum container in a direction opposite to the detachment direction.

5. The cryocooler according to claim 1, wherein the liquid refrigerant container is fixed to the cooling stage.

6. The cryocooler according to claim 5, wherein the refrigerant gas pipe includes a check valve disposed to enable a refrigerant gas to be introduced from the liquid refrigerant container into the refrigerant gas chamber.

7. A cryogenic system comprising:

a liquid refrigerant container disposed inside a vacuum container, and including a container wall that separates a liquid refrigerant from a vacuum region and a recondensing portion provided on the container wall;

a cryocooler mounted on the vacuum container to cool the liquid refrigerant container, wherein the cryocooler includes:

an attachment flange forming a refrigerant gas chamber between a mounting port of the vacuum container and the attachment flange when the cryocooler is mounted on the mounting port, and movable in a detachment direction by raising a pressure of the refrigerant gas chamber, a cooling stage disposed in the vacuum region to cool the recondensing portion, and movable from a cooling position in contact with the recondensing portion to a non-cooling position separated from the recondensing portion in response to a movement of the attachment flange in the detachment direction, and wherein the refrigerant gas chamber is connected to the liquid refrigerant container, wherein the cryogenic system further comprises:

refrigerant gas pipe connecting the liquid refrigerant container to the refrigerant gas chamber.

8. The cryogenic system according to claim 7, wherein the refrigerant gas pipe includes a check valve disposed to enable a refrigerant gas to be introduced from the liquid refrigerant container into the refrigerant gas chamber.

* * * * *